United States Patent [19]

Klaenhammer et al.

[11] 4,079,772

[45] Mar. 21, 1978

[54] WINDOW SHADE SEALING SYSTEM

[75] Inventors: Bryan L. Klaenhammer, Hugo; Edward A. Adams, St. Paul, both of Minn.

[73] Assignee: Minnesota Mining and Manufacturing Company, St. Paul, Minn.

[21] Appl. No.: 646,556

[22] Filed: Jan. 5, 1976

[51] Int. Cl.[2] ..... A47H 3/00; A47G 5/02

[52] U.S. Cl. ..... 160/268 R; 160/238

[58] Field of Search ..... 160/238, 266–273, 160/354, 120, 121, 122

[56] References Cited

U.S. PATENT DOCUMENTS

| | | | |
|---|---|---|---|
| 2,537,611 | 1/1951 | Walton | 160/120 |
| 3,251,399 | 5/1966 | Grossman | 160/180 |
| 3,679,505 | 7/1972 | Hinderaker et al. | 160/354 |
| 3,805,872 | 4/1974 | Lorber | 160/354 |

*Primary Examiner*—Peter M. Caun

*Attorney, Agent, or Firm*—Cruzan Alexander; Donald M. Sell; William B. Barte

[57] ABSTRACT

A system for controlling the transmission of heat through architectural windows is disclosed in which a magnetized strip is disposed along a major periphery of a frame supporting the window and a flexible window shade is supported adjacent to the frame and is magnetically attracted to the magnetized strip on the frame by a flexible sealing strip secured to the shade. The sealing strip contains a layer of magnetizable particles in a flexible polymeric binder.

9 Claims, 2 Drawing Figures

WINDOW SHADE SEALING SYSTEM

BACKGROUND OF THE INVENTION

1. Field of the Invention

This invention relates to systems for removably sealing a closure member to an opening, such as a window shade to a frame using magnetic attractive forces.

2. Description of the Prior Art

It has long been appreciated that magnetic forces could be desirably utilized to secure various types of coverings to a window frame. For example, U.S. Pat. No. 3,679,505 (Hinderaker and Nelson) discloses a method of sandwiching a flexible insect screen between parallel strips of a flexible rubber based magnet such as Plastiform ®, manufactured by Minnesota Mining and Manufacturing Company, St. Paul, Minn., such that when the screen is magnetically attracted to a vehicle window frame substantially no gaps between the screen and frame are present, thus facilitating the use of the vehicle for sleeping accommodations during camping trips.

Flexible window coverings are also disclosed in U.S. Pat. Nos. 2,321,078 and 2,514,316. While not there suggested, such coverings could also be held in place via magnets disposed about the periphery of the covering. U.S. Pat. No. 3,133,324 discloses the use of magnetic fasteners when using conventional rigid window constructions.

All known window systems using magnetic attraction provide a magnet construction on the closure element and a magnetizable element providing a magnetic flux return path in the frame. In some systems, the flux path is present as a result of the intrinsic ferromagnetic nature of the frames such as a vehicle body, while in other systems a separate ferromagnetic strip is inserted into the frame. Even when "flexible" rubber based magnets such as employed in U.S. Pat. No. 3,679,505 are so used, a relatively thick and stiff member is present which precludes using the closure member in roll-up form ala a conventional window shade.

SUMMARY OF THE INVENTION

The recent, greatly intensified, importance placed on conservation of energy has resulted in a greater concern for reducing heat loss through architectural windows. Typical constructions which have found increasing acceptance in effecting such a reduction are solar control films adhered to windows such that internally generated heat is reflected back into the room. While such permanently adhered films are satisfactory for certain applications, they are not desirable in other installations, such as on south facing windows which may realize a net gain in energy be maximizing the influx of solar energy during the day, while minimizing the loss of internal heat during cloudy days and at night. The desire to minimize the heat loss in such installations has emphasized the need for a flexible heat shield, i.e., shade, which can be removably sealed to existing frames while yet allowing the shield to be rolled up during periods when influx of solar radiation is desired.

In the present invention, such a capability is provided by a sealing strip adapted for use in a window shade and frame combination in which a magnetized strip is disposed along a major portion of the periphery of the frame and the sealing strip is secured to the shade such that when the shade is in juxtaposition with the frame the sealing strip is attracted to the magnetized strip, thereby forming a reclosable seal between the shade and the frame to inhibit convection currents. In this invention, the sealing strip comprises a layer of magnetically soft particles, such as a ferromagnetic stainless steel powder, in a flexible polymeric binder, which particles have a saturation induction in excess of 4000 gauss, have a particle size ranging between 50 and 1000 micrometers, and are present in the layer in an amount ranging between 0.01 and 0.2 grams/cm$^2$, and an adhesive, preferably a layer of pressure sensitive adhesive, for securing the sealing strip to the window shade. The layer of magnetically soft particles is conveniently characterized in terms of the shear force required to slide a section of the sealing strip having a defined area from a standard magnet prepared from a section of the permanent magnetized strip having a further defined area and magnetic attractive force. In such a test, the standard magnet is fabricated to have a substantially planar surface of one cm square and to have a magnetic attraction force such that it will stay in surface contact with a one cm square section of low carbon steel against a force applied normal to the surface of the sections of 70 grams. A one square cm of the sealing strip is then placed in surface contact with the standard magnet. Under such conditions, the sealing strip of the present invention will stay in position against a shear force of 1 gram.

In a further embodiment of the present invention, such a sealing strip is permanently affixed to a window shade and forms a part of a system including a frame having the permanent magnetized strip disposed along a major portion of the periphery of the frame.

DESCRIPTION OF THE PREFERRED EMBODIMENT

Figure 1:
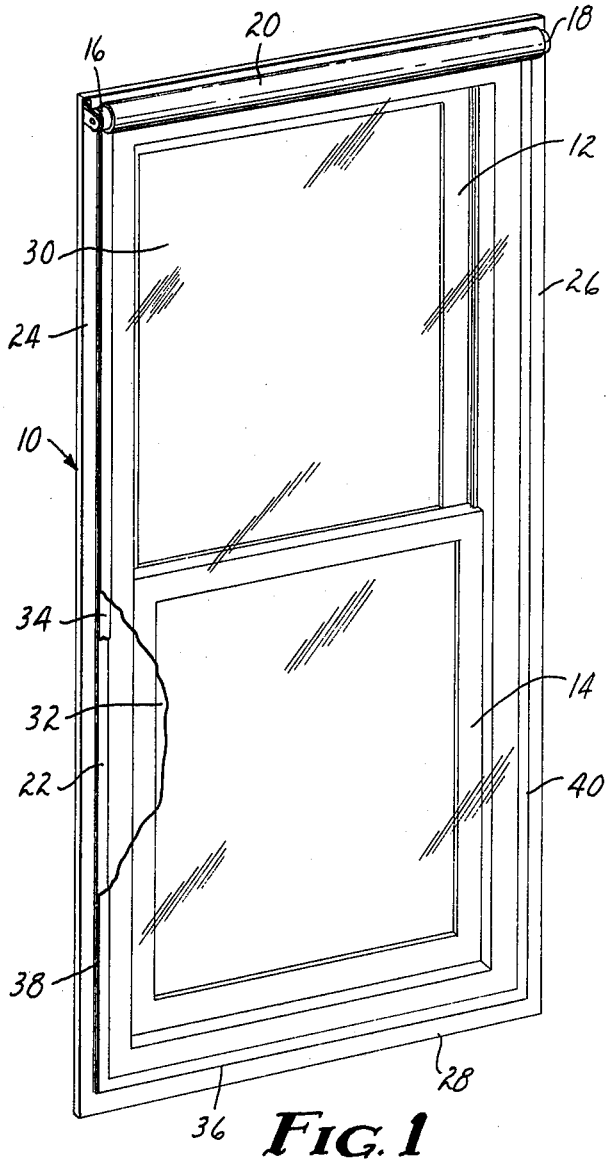
FIG. 1 is a partially cut-away perspective view of a window frame and shade sealing system according to the present invention.

FIG. 1 discloses a window frame 10 having mounted thereon in a conventional manner double hung sashes 12 and 14 respectively. Mounted at the top of the frame are brackets 16 and 18 for supporting a roll-up type roller shade 20. A flat narrow strip of a flexible rubber based magnet 22 such as Plastiform ®, type M.G.O. 1017 manufactured by Minnesota Mining and Manufacturing Company and disclosed in U.S. Pat. No. 2,999,275 is secured along the vertical sides 24 and 26 of the frame 10 and along the bottom horizontal side 28. Such a magnetized strip has a layer of pressure sensitive adhesive secured to one surface of the strip, which adhesive layer is protected prior to installation by a release liner. The strip is magnetized with alternating magnetic poles extending across its breadth, 8 poles per in (3.2 poles/cm). A 60 mil (0.15 cm) thick section typically exhibits an external magnetic field such that a 1 cm square section of the magnetized strip will stay in surface contact with a 1 cm square section of low carbon steel against a force applied normal to the surface of the sections of 70 grams. I.e., that it will withstand a normal force of at least one pound/square inch (70 grams/cm$^2$). A preferred installation utilizes a ½ inch (1.2 cm) wide section of such a strip, 60 mils (0.15 cm) thick. Upon installation, the release liner is stripped off the magnetized strip and the adhesive layer is pressed against the frame. Other magnetized strips without the adhesive layer may be secured by a variety of mechanical fasteners. Similarly, magnetized strips of a nonflexible construction such as a length of ceramic magnet could also be used.

In order to minimize air convection currents which increase the heat transfer through the windows 30 and 32, it is preferred that the magnetized strip 22 extend substantially continuously along the three sides 24, 26 and 28 of the frame, without an appreciable gap therebetween. In the event the bottom horizontal section 28 of the frame is not in the same plane as the vertical sections 24 and 26, the magnetized strip along the horizontal section may be eliminated or positioned in another plane.

In order to maximize the magnetic attractive force provided by the magnetized strip 22, it is preferably magnetized with an alternating pole configuration extending across the breadth of the strip such as having 2–6 alternating poles per centimeter, however, other magnetization configurations may likewise be used. Furthermore, if the magnetizable material in the sealing strip is not saturated by the field of the magnetized strip, the attractive force may be improved by providing a flux return path in back of the magnetized strip. Such a path is intrinsically present if the frame 10 is of a ferromagnetic construction. Likewise, an additional ferromagnetic strip may be inserted between the frame 10 and the magnetized strip 22.

The shade 20 may be constructed of any of a variety of conventional sheet materials such as fabrics or flexible polymeric sheeting. In a preferred embodiment, the shade 20 comprises a polymeric sheet having an infrared-reflecting coating on at least one surface. A magnetizable sealing strip 34 is secured to the bottom edge 36 and to the sides 38 and 40 of the shade 20 such that when the shade 20 is in juxtaposition with the frame 10, the sealing strip 34 is attracted to the magnetized strip 22, thereby forming a reclosable seal.

Figure 2:
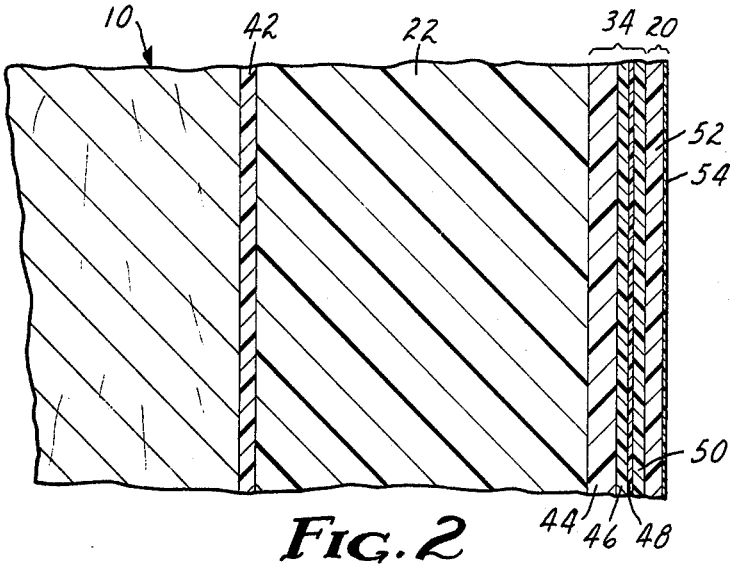
FIG. 2 is a cross-section of the shade sealing system of FIG. 1.

The various elements of the present invention are more clearly shown in the cross-sectional view of FIG. 2. In that figure, it may be seen that the magnetized strip 22 is secured to the frame 10 via a layer of pressure sensitive adhesive 42. The shade 20 and sealing strip 34 are further shown to comprise a number of layers. The sealing strip 34 includes a layer of magnetizable particles 44 in a flexible polymeric binder 46, which binder adheres the particles 44 to a polymeric substrate 48. The adhesive layer 50 is further provided to adhere the strip 34 to the shade 20. In a preferred embodiment, the sealing strip 34 is made by coating a conventional double coated pressure sensitive adhesive tape, such as Type 444 manufactured by Minnesota Mining and Manufacturing Company, with ferromagnetic particles, after which the particles are pressed into the tape surface to maximize the adherence thereto. Particularly desirable constructions may be formed from 40–140 mesh particles having an average particle size ranging between 100–400 micrometers of ASM type 410 ferromagnetic stainless steel. Similarly, any ferromagnetic particle having a saturation induction in excess of 4000 gauss is suitable for use in the present invention. Such particles may be formed of materials selected from the ferromagnetic elements (iron, cobalt and nickel, which have a saturation induction of approximately 21,000, 18,000 and 6,000, respectively) as well as alloys including such materials as ferromagnetic oxides and ferrites. In a preferred embodiment, magnetically soft ferromagnetic particles of Fe and ferromagnetic stainless steel are utilized. Such particles are preferably applied to the adhesive tape in an amount ranging between 0.01 and 0.2 grams/cm$^2$.

It has been found that if extremely small particles are dry coated onto a previously prepared adhesive surface, the small particles rapidly detackify the adhesive surface and result in a mono layer in which the coating weight is insufficient to provide adequate attractive force for many applications. Conversely, if large particles are provided, insufficient contact of the particles with the adhesive may occur such that the particles are readily removed from the adhesive layer. Typically, such a construction is further provided with a release liner adjacent the exposed surface of the adhesive layer 50. Such a liner is advantageous in that the sealing strip 34 may be separately marketed and applied to pre-cut shade materials as a separate processing step. Where the shade material and the sealing strip are to be manufactured as an integral unit, an adhesive/binder material may be applied directly to the edges of the shade material and the magnetizable particles applied directly to the binder without the use of an intermediate substrate such as the polymeric sheet 48.

In order to provide an adequate seal between the frame 10 and shade 20, it has been found desirable that the magnetic attractive force between the frame and the shade exceed a certain force. This force can be varied both by modifying the magnetic field provided by magnetized strip 22 or by modifying the saturation induction of ferromagnetic particles in the sealing strip 34. It has been found that an attractive force as expressed hereinabove in terms of the shear force in excess of approximately 1 gram/cm$^2$ is sufficient to provide a seal in applications where the windows 30 and 32 are allowed to be opened, such that air currents may be directed against the shade 20.

In two examples where 40 mesh particles of iron and 50 mesh particles of type 410 stainless steel were coated onto type 444 double coated tape in the manner discussed hereinabove, resulting in a coating weight of 0.082 and 0.050 grams/cm$^2$ respectively, which tapes were than applied to a smooth polyester sheet, a shear force of 9.0 and 6.0 grams respectively was observed for 1 cm$^2$ sections when the smooth surface of the polyester sheets were adjacent the magnet. The holding force is, of course, appreciably greater when the magnet and magnetizable layer are in direct contact, resulting in enhanced magnetic coupling and greater friction between the members.

In a particularly preferred construction, the shade 20 comprises a polymeric sheet 52 such as polyester or similar materials onto which is coated an infrared-reflecting layer 54. The layer 54 typically consists of an evaporated thin film such as gold, silver, copper or aluminum, which layer may also be sandwiched between dielectric layers in order to provide enhanced antireflection of visible light. When a conventional opaque vinyl shade was sealed to a typical architectural window frame fitted with single pane windows via the described sealing strips and flexible magnetized strips applied substantially continuously along the sides and bottom of the frame, a 44% reduction in the heat loss over that of the same, but unsealed, shade was observed.

Having thus described the present invention, what is claimed is:

1. A system for sealing a flexible roll-up type window shade to a cooperating window frame to inhibit convection currents which otherwise result in unnecessary heat loss comprising a substantially continuous permanently magnetized strip adapted to be disposed along a major portion of the periphery of the window frame, a flexible magnetizable sealing strip, one surface of which is provided with an adhesive means securing the strip to the flexible roll-up window shade, which sealing strip comprises a layer of magnetically soft particles in a flexible polymeric binder, which particles have a saturation induction in excess of 4000 gauss and are present in the layer in an amount ranging between 0.01 and 0.2 grams/cm$^2$ such that a one cm square section of the sealing strip in surface contact with a one cm square section of said magnetized strip having an attractive force of 70 gms per cm$^2$ will stay in position against a shear force of one gram, and said adhesive means securing said sealing strip to a roll-up window shade, such that when the window shade is extended parallel to the frame the window shade may be secured to the frame by magnetic attraction of the magnetically soft particles to the magnetized strip to inhibit air flow between the shade and the frame while permitting ready removal and replacement thereof.

2. A window shade and window frame combination comprising a window frame having a magnetized strip disposed along a major portion of the periphery of the frame, means for supporting a roll-up type window shade adjacent the frame, a flexible roll-up type window shade mounted on the supporting means and adapted to be positioned in juxtaposition with the frame, and a sealing strip containing a layer of magnetically soft particles in a flexible polymeric binder adhered to those portions of the shade which are opposite substantially the length of the magnetized strip when the shade is in juxtaposition with the frame, said layer containing magnetically soft particles having a saturation induction in excess of 4000 gauss and being present in the layer in an amount ranging between 0.01 and 0.2 grams/cm$^2$ such that a one cm square section of the sealing strip in surface contact with a one cm square section of said magnetized strip having an attractive force of 70 grams/cm$^2$ will stay in position against a shear force of 1 gram, such that when the shade is extended parallel to the frame there is provided a sufficient magnetic attraction of the shade to the frame to seal the shade to the frame to inhibit convection currents.

3. A combination according to claim 2, wherein the shade comprises a flexible polymeric substrate and a plurality of layers on the substrate for reflecting infrared radiation and for increasing the transmission of visible light.

4. A flexible magnetic sealing strip in a roll-up type window shade and frame combination wherein a magnetized strip is disposed along a major portion of the periphery of the frame and the sealing strip is adhered to the shade such that when the shade is extended parallel to opposing sides of the frame and is in juxtaposition therewith, the sealing strip is attracted to the magnetized strip thereby forming a recloseable seal between the shade and frame to inhibit convection currents, wherein the sealing strip comprises a layer of magnetically soft ferromagnetic particles in a flexible polymeric binder, which particles have a saturation induction in excess of 4000 gauss, have a particle size ranging between 50 and 1000 micrometers, and are present in said layer in an amount ranging between 0.01 and 0.2 grams/cm$^2$ such that 1 cm square section of the sealing strip in surface contact with a 1 cm square section of the magnetized strip having an attractive force of 70 grams/cm$^2$ will stay in position against a shear force of 1 gram, and a layer of adhesive secured to one surface of the layer of magnetizable particles.

5. A magnetic sealing strip according to claim 4 wherein the particles are iron.

6. A magnetic sealing strip according to claim 4 wherein the particles are magnetic stainless steel.

7. A strip according to claim 4 further comprising a substrate of a flexible polymeric sheet having a thickness in the range between 0.5 and 5 mils, the layer of particles being adhered to one surface of the sheet, and the adhesive layer adhered to the opposite surface of the sheet, whereby the adhesive layer facilitates disposition of the sealing strip about the periphery of a shade.

8. A method for sealing a flexible roll-up type window shade to a cooperating window frame to inhibit convection currents which otherwise result in unnecessary heat loss comprising affixing a substantially continuous permanently magnetized strip along a major portion of the periphery of the window frame, providing a flexible magnetically soft sealing strip, which strip comprises a layer of magnetically soft particles in a flexible polymeric binder, which particles have a saturation induction in excess of 4000 gauss and are present in the layer in an amount ranging between 0.01 and 0.2 grams/cm$^2$ such that a 1 cm square section of sealing strip in surface contact with a 1 cm square section of said magnetized strip having a magnetic attractive force of 70 grams/cm$^2$ will stay in position against a shear force of 1 gram, and adhering a surface of said sealing strip to a roll-up type window shade, such that when the window shade is extended parallel to the frame, the shade may be secured to the frame by magnetic attraction of the particles to the magnetized strip to inhibit air flow between the shade and the frame while permitting ready removal and replacement thereof.

9. A window shade and window frame combination comprising a window frame having magnetized strips extending along substantially the length of opposite sides of the frame, means for supporting a roll-up window shade adjacent another side of the frame, a flexible roll-up window shade mounted on the supporting means and adapted to be extended parallel to said opposite sides and thereafter to be positioned in juxtaposition with the frame, and sealing strips containing a layer of magnetically soft particles in a flexible polymeric binder and adhered to the shade opposite substantially the length of the magnetized strips when the shade is in juxtaposition with the frame, said layer containing magnetically soft particles having a saturation induction in excess of 4000 gauss and being present in the layer in an amount ranging between 0.01 and 0.2 grams/cm$^2$ such that a one cm square section of the sealing strips in the surface contact with a one cm square section of said magnetized strips having a magnetic attractive force of 70 grams/cm$^2$ will stay in position against a shear force of 1 gram, thereby providing a sufficient magnetic attraction of the shade to the frame to seal the shade to the frame to inhibit convection currents.

* * * * *